US005904014A

United States Patent [19]

Ripamonti et al.

[11] Patent Number: 5,904,014

[45] Date of Patent: May 18, 1999

[54] FIREPROOF TRIM FOR A LANDING DOOR FOR A LIFT

[75] Inventors: Rodolfo Ripamonti; Gianluca Novellati, both of Milan, Italy; Jori Hägg, Riihamäki; Mika Lehtonen, Riihimäki, both of Finland; Giuseppe Pugliese, RHO Milan; Pierpaolo Piccin, Milan, both of Italy

[73] Assignee: Kone Oy, Helsinki, Finland

[21] Appl. No.: 08/838,041

[22] Filed: Apr. 22, 1997

[30] Foreign Application Priority Data

Apr. 22, 1996 [IT] Italy ..... TO96A0319

[51] Int. Cl.[6] ..... E06B 1/04

[52] U.S. Cl. ..... 52/217; 52/211; 52/212; 49/505

[58] Field of Search ..... 52/211, 212, 213, 52/215, 217; 49/505

[56] References Cited

U.S. PATENT DOCUMENTS 4,878,325 11/1989 Van Tuyl et al. ..... 52/217
5,182,880 2/1993 Berge et al. ..... 52/211 X
5,187,898 2/1993 McKann ..... 52/217 X
5,220,748 6/1993 Chadbourne ..... 52/217 X
5,412,909 5/1995 Wu ..... 52/212 X
5,619,823 4/1997 Ruff et al. ..... 52/210 X

*Primary Examiner*—Carl D. Friedman
*Assistant Examiner*—Beth A. Aubrey
*Attorney, Agent, or Firm*—Birch, Stewart, Kolasch & Birch, LLP

[57] ABSTRACT

The trim includes a fireproof profiled element (11) of incombustible material, preferably steel, with an L-shaped cross section having a first limb (11*a*) fixed to a jamb (1, 2) or transom (3) of the door frame and a second limb (11*b*) located adjacent the corresponding side or face (4–6) of the door opening. In front of the fireproof element (11) is a profiled cover element (14) having a channel-shaped cross section which has a first limb (14*a*) which bears against the jamb (1, 2) or transom (3) of the door frame and a second limb (14*b*) force-fitted between the second limb (11*b*) of the fireproof element (11) and the associated face (4–6) of the door opening. Fixing devices (15) clamp the second limbs (14*b*) of the cover elements (14) against the associated faces (4–6) of the door opening.

22 Claims, 2 Drawing Sheets

FIREPROOF TRIM FOR A LANDING DOOR FOR A LIFT

The present invention relates to a fireproof trim for a landing door for a lift, in which the landing door has a frame with two side posts, or jambs, and an upper cross-member, or transom, intended to be fixed to corresponding sides or faces of a door opening.

The primary object of the present invention is to provide a trim for ensuring effective fireproofing of the zone between the jambs and transom of the frame and the sides or faces of the door opening, which is also simple and economical to manufacture, easy to install and aesthetic in appearance.

These and other objects are achieved in accordance with the invention by a trim which includes, for each jamb and for the transom of the door frame,

- a fireproof profiled element of incombustible material, preferably metal, of substantially L-shaped cross-section with a first limb intended to be applied against and fixed to that face of the jamb or transom which faces the landing and a second limb intended to be located adjacent the corresponding face of the door opening,
- a profiled cover element having a channel-shaped cross section intended to be located in front of the fireproof element with its channel facing the fireproof element, the cover element having a first limb intended to bear against that face of the jamb or transom facing the landing, and a second limb intended to be force-fitted between the second limb of the fireproof element an the associated face of the door opening, and
- a fixing device which can be applied to the jamb or transom of the door frame for clamping the second limb of the cover element against the associated face of the door opening.

BRIEF DESCRIPTION OF THE DRAWINGS

Further characteristics and advantages of the invention will become apparent from the detailed description which follows, given purely by way of non-limitative example, with reference to the appended drawings, in which.

DETAILED DESCRIPTION OF THE PREFERRED EMBODIMENTS

Figure 1:
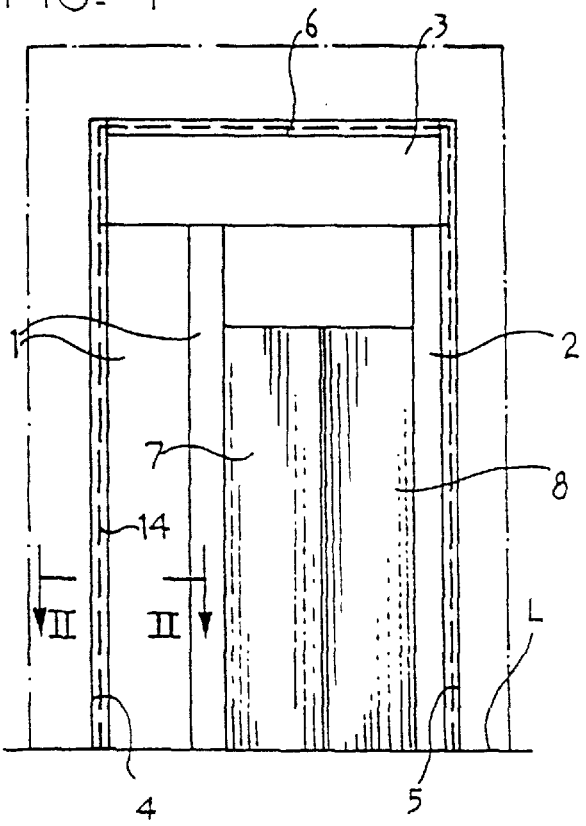
FIG. 1 is an elevational view of a landing door for a lift provided with fireproof trims according to a preferred embodiment of the present invention.

FIG. 1 shows a landing door for a lift. This door includes a frame having two side posts, or jambs, 1 and 2 and an upper cross-member, or transom, 3 fixed to corresponding side and upper faces 4, 5 and 6 of a door opening.

In FIG. 1 the door is shown as it is seen from the associated landing L. In the embodiment illustrated by way of example, the door has two sliding panels 7 and 8.

Between the jambs 1, 2 and the corresponding faces 4 and 5 of the door opening are respective fireproof trims according to the present invention. A similar trim is located between the transom 3 and the corresponding upper face 6 of the door opening. Only one of these fireproof trims will be described below with reference to FIG. 2 and, in particular, the trim mounted between the jamb 1 and the associated face 4 of the door opening. The fireproof trims associated with the other jamb and the transom of the door frame preferably have similar structures to that which will be described.

Figure 3:
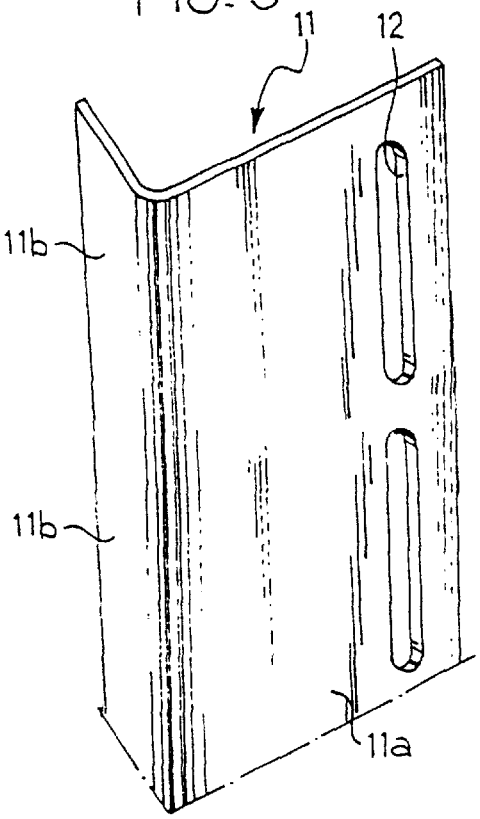
FIG. 3 is a perspective view of part of a fire-proof element included in the trim of the present invention.
Figure 2:
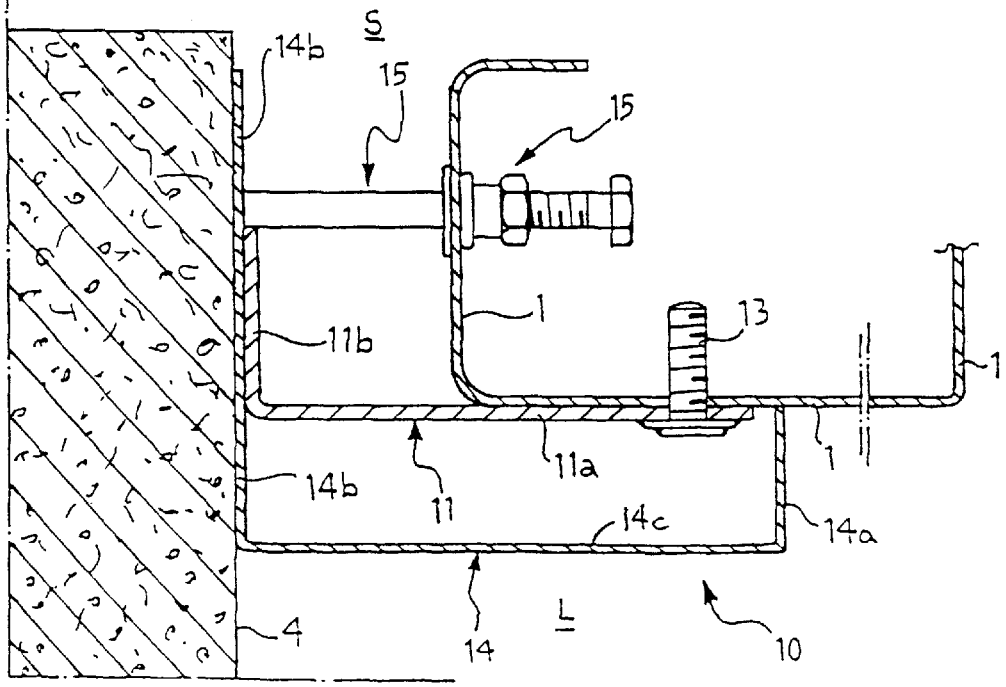
FIG. 2 is a sectional view on an enlarged scale taken along the line II—II of FIG. 1.

With reference to FIG. 2, a fireproof trim 10 according to a preferred embodiment of the present invention comprises a fireproof profiled element 11 of incombustible material, preferably steel, having a substantially L-shaped cross-section. This element 11 has a first limb 11*a* which is applied against and fixed to the face of the jamb 1 facing the landing. As is seen in FIG. 3, the limb 11*a* of the fireproof element 11 conveniently has one or more longitudinally-elongate apertures 12 through which extend fixing screws 13 (FIG. 2) which connect the fireproof element to the associated jamb 1 of the door frame. Only one of the profiled elements 11 is preferably used over the length of cover element 14, but a plurality of smaller ones can be used as well. If a plurality of profiled elements 11 is used, then they should basically abut one another in order to minimize the gaps between them. Profiled element 11 is, after all, essential to the fireproofing ability of the present invention.

The fireproof profiled element 11 has a second limb 11*b* facing the lift shaft or well S and located adjacent the corresponding face 4 of the door opening (FIG. 2).

A profiled cover element 14 has a substantially channel-shaped cross section and is located in front of the fireproof element 11 with its channel facing the fireproof element. The cover element 14 has a first limb 14*a* which bears against the face of the jamb 1 facing the landing and a second limb 14*b* force-fitted between the limb 11*b* of the fireproof element 11 and the corresponding face 4 of the door opening. The limbs 14*a*, 14*b* may be parallel to each other but need not be. They are preferably separated by an intermediate extension 14*c*.

In the embodiment shown by way of example in FIG. 2, the limb 14*b* of the cover element 14 extends such that its end projects beyond the limb 11*b* of the fireproof element 11 toward the lift shaft of well S.

The jamb 1 of the door frame has an associated plurality of fixing bolts 15 only one of which is shown in FIG. 2. These bolts 15 are preferably screwed in so that their ends bear on that portion of the limb 14*b* of the cover element 14 which projects beyond the limb 11*b* of the fireproof element 11 so as to clamp the cover element 14 against the face 4 of the door opening. Other clamping elements, such as spring-loaded devices, may substitute for, or supplement, the bolts 15.

In the event of fire, even if the door and the door frame deform as a result of their thermal expansion, the gaps or joints between the door frame and the associated faces 4–6 of the door opening remain closed since the fireproof elements 11 can slide relative to the frame as the apertures 12 engaged by the fixing screws 13 are elongate and, moreover, the limbs 14*b* of the cover element 14 act as slide surfaces.

The fireproof trims according to the present invention are easy to install, with installation being carried out mainly from the landing. They are particularly quick and simple to construct and assemble. When installed, the trims are also aesthetically pleasing.

Figure 4:
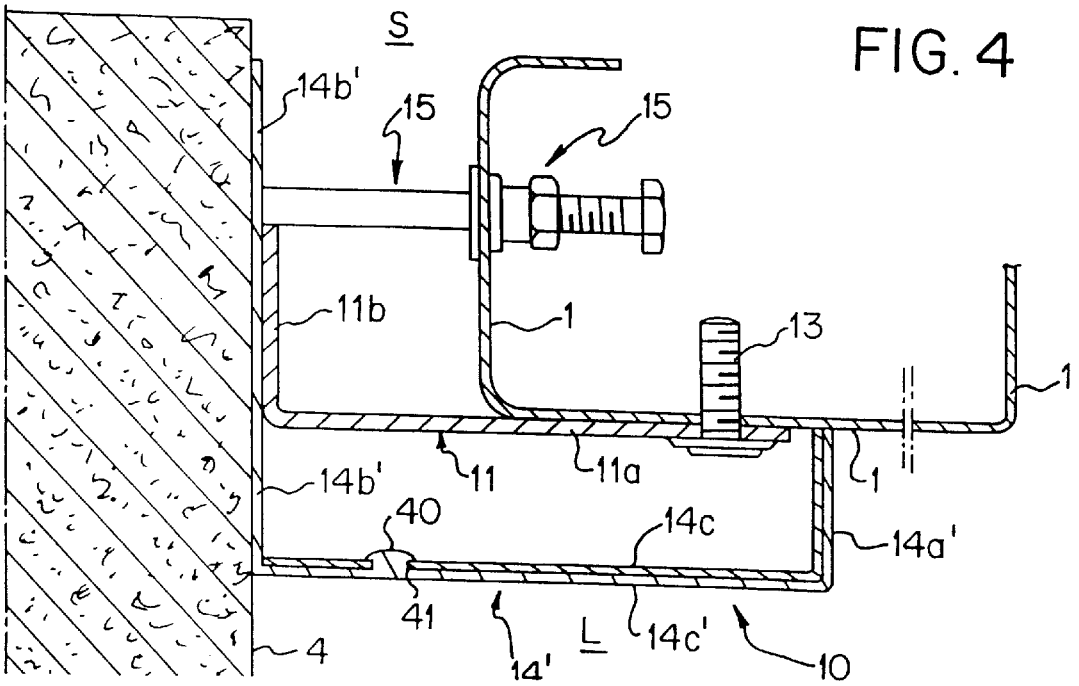
FIG. 4 is a sectional view similar to FIG. 2, but showing another embodiment of the present invention.

As seen in FIG. 1, cover element 14 typically will extend beyond the height of the jamb 1 of the door frame. In order to provide for easy installation of the cover element 14, it may include two (or more) telescoping pieces. FIG. 4 shows an elevational view similar to FIG. 2, but with a telescoping cover element 14' which extends beyond the height of the cover element 14. Telescoping cover element 14' includes a first arm 14*a*' and a second arm 14*b*' similar to the first and second arms 14*a*, 14*b* of the cover element 14. The intermediate extension 14*c*' is barely longer than intermediate extension 14*c* in order to allow the telescoping cover element 14' to surround the cover element 14.

Telescoping cover element 14' will overlap cover element 14 in the height direction of the jamb. In this overlapping region, the elements 14, 14' can be secured to each other by one or more securing elements, such as a head 40 projecting through a corresponding elongated hole 41. The end of the first arm 14*a*' can also be provided with a U-shaped portion (not shown) to grasp the edge of the first arm 14*a* of the lower cover element 14. The U-shaped portion is preferably made flush with the jamb 1.

Figure 5:
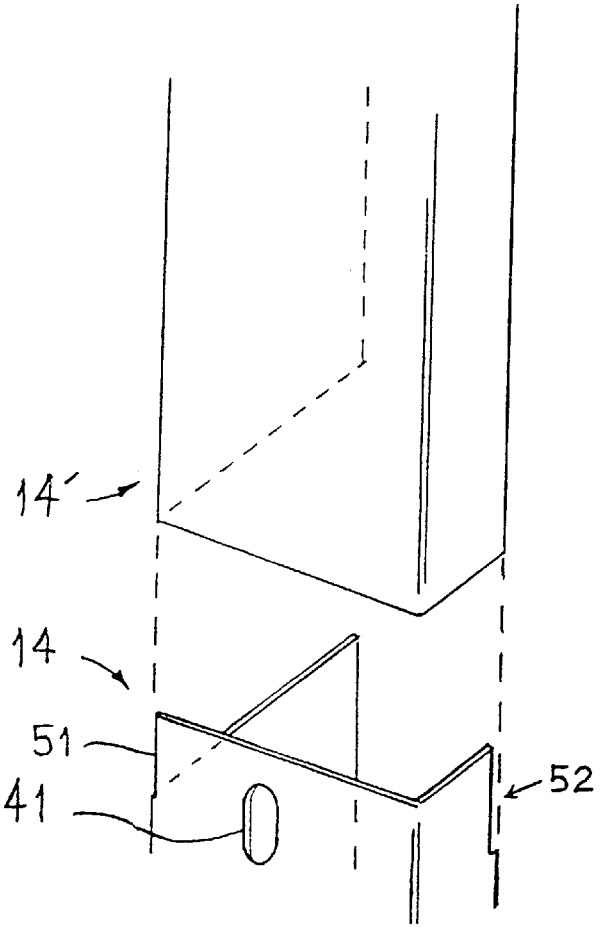
FIG. 5 is a perspective and exploded view of portions of FIG. 4.

In the overlapping region of the elements 14, 14' the intermediate extension 14*c* of the lower element 14 preferably extends higher than the second arm 14*b* so that the second arm 14*b*' of the telescoping cover element 14' can be secured by fixing bolts 15. Notch 51 shown in FIG. 5 can also be formed in the cover element 14 in order to provide for flush mounting of telescoping cover element 14' against the jamb 1, and notch 52 can be formed in the first arm 14 in order to fit inside the U-shaped edge (not shown) of the first arm 14*a*'.

Naturally, the principle of the invention remaining the same, the forms of embodiment and details of construction may be varied widely with respect to that described and illustrated purely by way of non-limitative example, without thereby departing from the scope and equivalents of the claimed invention.

What is claimed is:

1. A fireproof trim for a landing door for a lift, in which the landing door has a frame with at least one jamb or transom intended to be fixed to a corresponding face of a door opening, said fireproof trim comprising:

a fireproof profiled element of incombustible material, said profiled element having a first limb fixed, when assembled, against a face of the jamb or transom which faces the landing, and a second limb located adjacent the corresponding face of the door opening; and a profiled cover element having a first limb bearing, when assembled, against the face of the jamb or transom facing the landing, and a second limb fitted between said second limb of said fireproof element and the corresponding face of the door opening.

2. The trim according to claim 1, wherein said fireproof profiled element has a substantially L-shaped cross section.

3. The trim according to claim 1, wherein said cover element lies on a side of said fireproof profiled element toward the landing, and said second limb of said cover element has a portion which extends away from the landing beyond an end of said second limb of said fireproof element.

4. The trim according to claim 3, further comprising:

fixing means for clamping said second limb of said cover element against the corresponding face of the door opening.

5. The trim according to claim 4, wherein said fixing means include bolts whose ends bear against said portion of said second limb of said cover element, thereby clamping said portion against the face of the door opening.

6. The trim according to claim 4, wherein said fireproof profiled element has a plurality of longitudinally-elongated apertures through which said fixing means extend for connecting said fireproof element to the associated jamb or transom of the door frame.

7. The trim according to claim 1, further comprising:

fixing means for clamping said second limb of said cover element against the corresponding face of the door opening.

8. The trim according to claim 1, wherein said fireproof profiled element has a plurality of longitudinally-elongated apertures, and further comprising means extending through said apertures for connecting said fireproof element to the associated jamb or transom of the door frame.

9. The trim according to claim 7, wherein said fixing means clamps said second limb of said profiled cover element flush against the face of the door opening.

10. The trim according to claim 1, wherein said profiled cover element has a channel-shaped cross section with the channel facing said fireproof profiled element.

11. The trim according to claim 1, further comprising:

a telescoping profiled cover element having a first limb bearing, when assembled, against the face of the jamb or transom facing the landing, and a second limb fitted against the corresponding face of the door opening, said telescoping profiled cover element overlapping and being adjustable relative to said profiled cover element.

12. The trim according to claim 1, wherein, when assembled, said first limb of said fireproof profiled element is attached to, and lies flush against, the face of the jamb or transom which faces the landing, and said second limb of said fireproof profiled element is substantially planar and at a right angle relative to its first limb.

13. A fireproof trim for filling a gap between a jamb or transom of a door frame and a face of a door opening, said fireproof trim comprising, when assembled:

a fireproof profiled element of incombustible material, said profiled element having a first limb lying flush against a face of the jamb or transom, and a second limb adjacent a corresponding face of the door opening, such that a gap between the jamb or transom and the face of the door opening is filled by said profiled element; and a profiled cover element having a first limb bearing against the face of the jamb or transom, and a second limb lying flush against the door opening, wherein said second limb of said fireproof profiled element presses against said second limb of said cover element.

14. The trim according to claim 13, wherein said first and second limbs of said fireproof profiled element are substantially at right angles with respect to each other, such that said second limb of said fireproof profiled element lies flush against said second limb of said cover element.

15. The trim according to claim 13, wherein said cover element lies on a first side of said fireproof profiled element, the first side corresponding to a landing side of the door frame, and further wherein said second limb of said cover element extends beyond an end of said second limb of said fireproof element as considered in a direction away from the landing side of the door frame.

16. The trim according to claim 15, further comprising:

means for pressing said second limb of said cover element against the corresponding face of the door opening.

17. The trim according to claim 16, wherein said means include bolts extending toward the face of the door opening, ends of said bolts bearing against said portion of said second limb of said cover element, thereby clamping said portion against the face of the door opening.

18. The trim according to claim 13, wherein said second limb of said cover element is forcibly pressed against the corresponding face of the door opening.

19. The trim according to claim 18, further comprising means for applying force to said second limb of said cover element.

20. The trim according to claim 13, further comprising means for connecting said fireproof profiled element to the associated jamb or transom of the door frame, said means extending through apertures in said fireproof profiled element and apertures in the jamb or transom.

21. The trim according to claim 13, wherein said profiled cover element has a channel-shaped cross section with the channel facing said fireproof profiled element.

22. The trim according to claim 13, further comprising:

a telescoping profiled cover element having a first limb bearing, when assembled, against the face of the jamb or transom facing the landing, and a second limb fitted against the corresponding face of the door opening, said telescoping profiled cover element overlapping and being adjustable relative to said profiled cover element.

* * * * *